US009938070B2

(12) United States Patent
Ogata et al.

(10) Patent No.: US 9,938,070 B2
(45) Date of Patent: Apr. 10, 2018

(54) NOZZLE CAP FOR AEROSOL CONTAINER

(71) Applicant: TOYO AEROSOL INDUSTRY CO., LTD., Tokyo (JP)

(72) Inventors: Ken Ogata, Tokyo (JP); Hirokazu Shimizu, Tokyo (JP); Toru Toma, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 174 days.

(21) Appl. No.: 14/952,631

(22) Filed: Nov. 25, 2015

(65) Prior Publication Data

US 2016/0083172 A1 Mar. 24, 2016

Related U.S. Application Data

(63) Continuation of application No. PCT/JP2014/064638, filed on Jun. 2, 2014.

(30) Foreign Application Priority Data

May 31, 2013 (JP) ..... 2013-116442

(51) Int. Cl.
*B65D 83/14* (2006.01)
*B65D 83/40* (2006.01)
(Continued)

(52) U.S. Cl.
CPC ..... *B65D 83/40* (2013.01); *B65D 83/205* (2013.01); *B65D 83/206* (2013.01);
(Continued)

(58) Field of Classification Search
CPC ..... B65D 83/34; B65D 83/16; B65D 83/68; B65D 83/345; B65D 83/206;
(Continued)

(56) References Cited

U.S. PATENT DOCUMENTS 2,982,448 A * 5/1961 Leonard ..... B65D 83/205 222/153.07
3,373,908 A * 3/1968 Crowell ..... B65D 83/205 222/402.13

(Continued)

FOREIGN PATENT DOCUMENTS

JP 2011-105384 A 6/2011
JP 2011-162227 A 8/2011

(Continued)

OTHER PUBLICATIONS

International Search Report dated Sep. 2, 2014, issued in corresponding application No. PCT/JP2014/064638.

*Primary Examiner* — Charles P Cheyney
(74) *Attorney, Agent, or Firm* — Westerman, Hattori, Daniels & Adrian, LLP

(57) ABSTRACT

Provided is a nozzle cap for aerosol container that can be used for cleaning a nozzle of an aerosol container that has a plurality of stems, and preventing the nozzle from being pushed down. The nozzle cap includes a plurality of bar-like pieces 11 that can be inserted from ejection ports 24 of a nozzle 20 into ejection-side communication passages 23*a* at least until distal ends 11*a* reach upper ends 22*d* of stem-like communication passages 22*a*, and a lower protrusion 14 that prevents the nozzle from being pushed down by abutting on a cover member 30 below ejection tubes 23 of the nozzle 20 when the bar-like pieces 11 are inserted into the ejection-side communication passages 23*a*.

6 Claims, 6 Drawing Sheets

(51) Int. Cl.

| | |
|---|---|
| ***B65D 83/20*** | (2006.01) |
| ***B65D 83/34*** | (2006.01) |
| ***B65D 83/68*** | (2006.01) |
| ***B65D 83/28*** | (2006.01) |
| ***B65D 83/22*** | (2006.01) |

(52) U.S. Cl.
CPC ..... *B65D 83/224* (2013.01); *B65D 83/28* (2013.01); *B65D 83/34* (2013.01); *B65D 83/345* (2013.01); *B65D 83/68* (2013.01); *B65D 83/7538* (2013.01)

(58) Field of Classification Search
CPC ..... B65D 83/205; B65D 83/40; B65D 83/28; B65D 83/224; B65D 83/753
USPC ... 222/123, 151, 402.13, 506, 402.1, 402.11, 222/153.11
See application file for complete search history.

(56) References Cited

U.S. PATENT DOCUMENTS 3,510,029 A * 5/1970 Doyle ..... B65D 83/206 222/402.12
3,904,088 A * 9/1975 Milbourne, Sr. .... B65D 83/205 222/402.11
6,290,109 B1 * 9/2001 Bougamont ..... B65D 83/345 222/546
6,739,481 B2 * 5/2004 Meshberg ..... B05B 11/0013 222/153.11
6,908,017 B2 * 6/2005 Mineau ..... B65D 83/345 222/148
7,500,621 B2 * 3/2009 Tryon ..... B05B 1/1654 222/402.1
7,527,173 B2 * 5/2009 Lasserre ..... B65D 83/205 222/153.11
8,925,765 B2 * 1/2015 Hanai ..... B65D 83/34 222/137
2006/0065674 A1 * 3/2006 Lasserre ..... B65D 83/68 222/137
2006/0219808 A1 10/2006 Woods

FOREIGN PATENT DOCUMENTS

| | | | |
|---|---|---|---|
| JP | 2011-213400 | A | 10/2011 |
| JP | 2012-30886 | A | 2/2012 |
| JP | 5115932 | B2 | 1/2013 |
| WO | 2014/192961 | A1 | 12/2014 |

* cited by examiner

NOZZLE CAP FOR AEROSOL CONTAINER

TECHNICAL FIELD

The present invention relates to a nozzle cap attached to an aerosol container that has a plurality of stems, and more particularly to a nozzle cap that can be used for cleaning the nozzle, and preventing the nozzle from being pushed down.

BACKGROUND ART

As a means of cleaning the nozzle of an aerosol container that has a plurality of stems, one described in Patent Document 1, for example, has hitherto been known. According to Patent Document 1, a cleaning member is attached to the nozzle body so as to be removably inserted into an ejection port of the nozzle body. The content can be expelled with the cleaning member being pushed into the nozzle body, and the residual content can be scraped out by pulling the cleaning member out of the ejection port after the ejection.

PRIOR ART DOCUMENT

Patent Documents

Patent Document 1: Japanese Patent Application Laid-open No. 2012-30886

SUMMARY OF THE INVENTION

Problems to be Solved by the Invention

However, the cleaning member described in Patent Document 1 has a complex structure so as to allow ejection of the content with the cleaning member being pushed into the nozzle body. It was also difficult to add a function, to the cleaning member, of preventing the nozzle from being pushed down when not in use.

The present invention was developed in view of the circumstances described above, and it is an object of the invention to provide a nozzle cap for aerosol container that can be used for cleaning the nozzle of an aerosol container that has a plurality of stems, and for preventing the nozzle from being pushed down.

Means for Solving the Problems

The subject matter and configuration of the present invention are as follows:

1. A nozzle cap for aerosol container to be attached to an aerosol container, including a nozzle connected to a plurality of stems of a mounting cup at one end and having an ejection port at the other end, and a cover member attached to the mounting cup, the nozzle including a stem connector that forms stem-side communication passages independently extending upward from respective stems, and ejection tubes that form ejection-side communication passages independently extending forward from upper ends of the respective stem-side communication passages, the nozzle cap including:

a plurality of bar-like pieces that can be inserted from the ejection port of the nozzle into the respective ejection-side communication passages at least until distal ends of the bar-like pieces reach the upper ends of the respective stem-side communication passages;

a circumferential wall formed continuously to base ends of the plurality of bar-like pieces via a front wall to surround the ejection tubes when the bar-like pieces are inserted into the ejection-side communication passages; and a lower protrusion protruding from an outer circumferential surface of the circumferential wall and abutting on the cover member below the ejection tubes of the nozzle when the bar-like pieces are inserted into the ejection-side communication passages, to thereby prevent the nozzle from being pushed down.

2. The nozzle cap for aerosol container according to item 1, wherein the stem connector of the nozzle is formed by a plurality of stem-side tubes that form independent stem-side communication passages, and the circumferential wall and the lower protrusion each include an extension that extends backward through between the plurality of stem-side tubes when the bar-like pieces are inserted into the ejection-side communication passages.

3. The nozzle cap for aerosol container according to item 1 or 2, wherein the cover member includes an actuator part that is provided above the nozzle and presses down the nozzle when turned via a hinge, and the nozzle cap further includes an upper protrusion protruding from the outer circumferential surface of the circumferential wall and abutting on the actuator part by the actuator part being pressed down when the bar-like pieces are inserted into the ejection-side communication passages.

4. The nozzle cap for aerosol container according to any one of items 1 to 3, wherein the two bar-like pieces each include an annular protrusion that makes sliding contact with the surface of the stem-side communication passages.

5. The nozzle cap for aerosol container according to item 4, wherein the annular protrusions each can engage with the upper ends of the stem-side communication passages when the bar-like pieces are inserted into the ejection-side communication passages.

Effects of the Invention

According to the present invention, by removing the nozzle from the stems, and by inserting the plurality of bar-like pieces of the nozzle cap into the ejection-side communication passages until the distal ends of the bar-like pieces reach the upper ends of the stem-side communication passages of the nozzle, the contents remaining inside the ejection-side communication passages can be pushed out of the nozzle through the stem-side communication passages, and thus the nozzle can be easily cleaned. Also, according to the present invention, when the aerosol container is not in use, the nozzle can be prevented from being pushed down by attaching the nozzle cap to the nozzle so that the bar-like pieces of the nozzle cap are inserted into the ejection-side communication passages, since the lower protrusion protruding from the circumferential wall of the nozzle cap abuts on the cover member below the ejection tubes of the nozzle.

Accordingly, the present invention can provide A nozzle cap for aerosol container that can be used for cleaning the nozzle of an aerosol container that has a plurality of stems, and preventing the nozzle from being pushed down.

EXPLANATION OF REFERENCE NUMERALS

Figure 1:
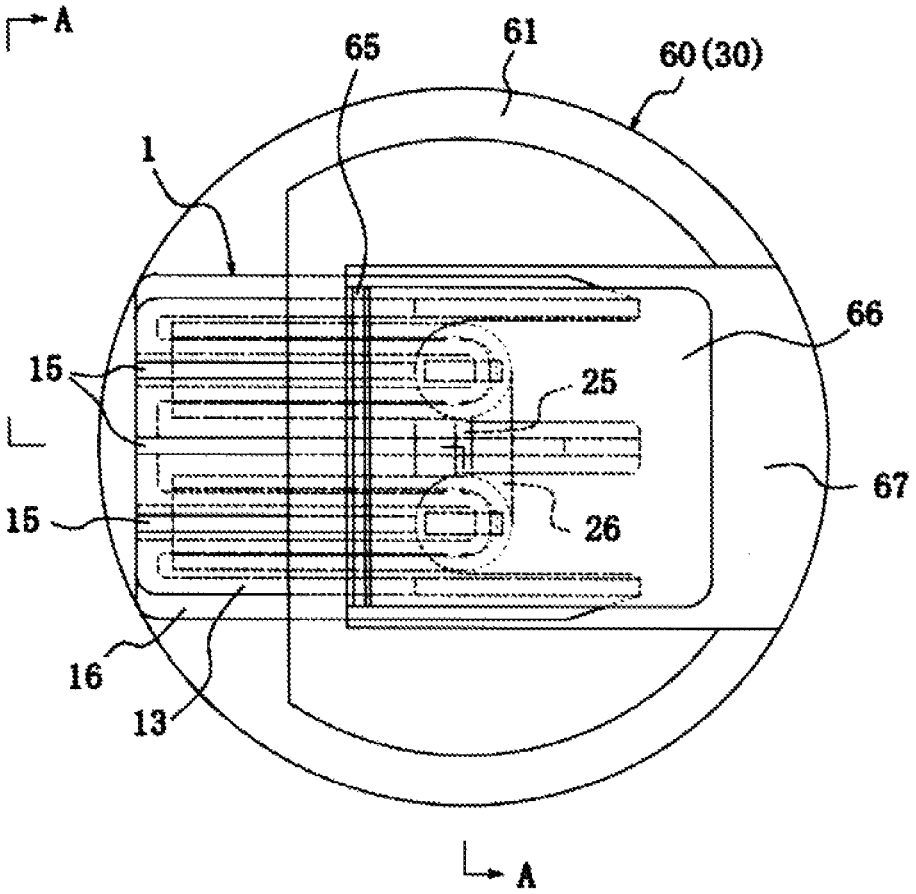
FIG. 1 is a plan view illustrating A nozzle cap for aerosol container according to one embodiment of the present invention in a state in which it is mounted to the aerosol container.

1: Nozzle cap
11: Bar-like piece
11*a*: Distal end
11*b*: Base end
11*c*: Outer circumferential surface
11*d*: Annular protrusion
12: Front wall
13: Circumferential wall
13*a*: Lower extension
13*b*: Lateral extension
13*c*: Upper extension
13*d*: Rear edge
14: Lower rib (lower protrusion)
14*a*: Lower extension (extension)
14*b*: Rear edge
15: Upper rib (upper protrusion)
15*a*: Upper extension
15*b*: Rear edge
16: Lateral rib
16*a*: Lateral extension
16*b*: Rear edge
17: Reinforcing rib
20: Nozzle
21: Stem connector
22: Stem-side tube
22*a*: Stem-side communication passage
22*b*: Large-diameter part
22*c*: Engaging convex section
22*d*: Upper end
23: Ejection tube
23*a*: Ejection-side communication passage
24: Ejection port
25: Vertical rib
26: Horizontal rib
27: Rib
30: Cover member
40: Aerosol container
41: Container body
42: Mounting cup
43: Annular rim
44: Stem
45: Projection
50: Lower cover (cover member)
51: Opening
52: Outer wall
52*a*: Upper tier part
52*b*: Middle tier part
52*c*: Lower tier part
52*d*: Positioning wall
52*e*: Cylindrical wall
52*f*: Engaging claw
52*g*: Claw
60: Upper cover (cover member)
61: Circumferential wall
61*a*: Top wall
62: Engaging hole
63: Pivoting piece
64: Connecting piece
65: Hinge
66: Actuator part
67: Inner bottom wall
67*a*: Opening
68: Inner side wall
69: Inner circumferential wall

MODES FOR CARRYING OUT THE INVENTION

Hereinafter, the nozzle cap for aerosol container according to one embodiment of the present invention will be illustrated and described in detail with reference to the drawings.

The "front" herein refers to an ejection port side of an ejection tube provided in the nozzle, while the "back (rear)" refers to the opposite side from the front along the axial line of the ejection tube. The "sides" refer to left and right directions when viewing the container from the front to the back.

Figure 2:
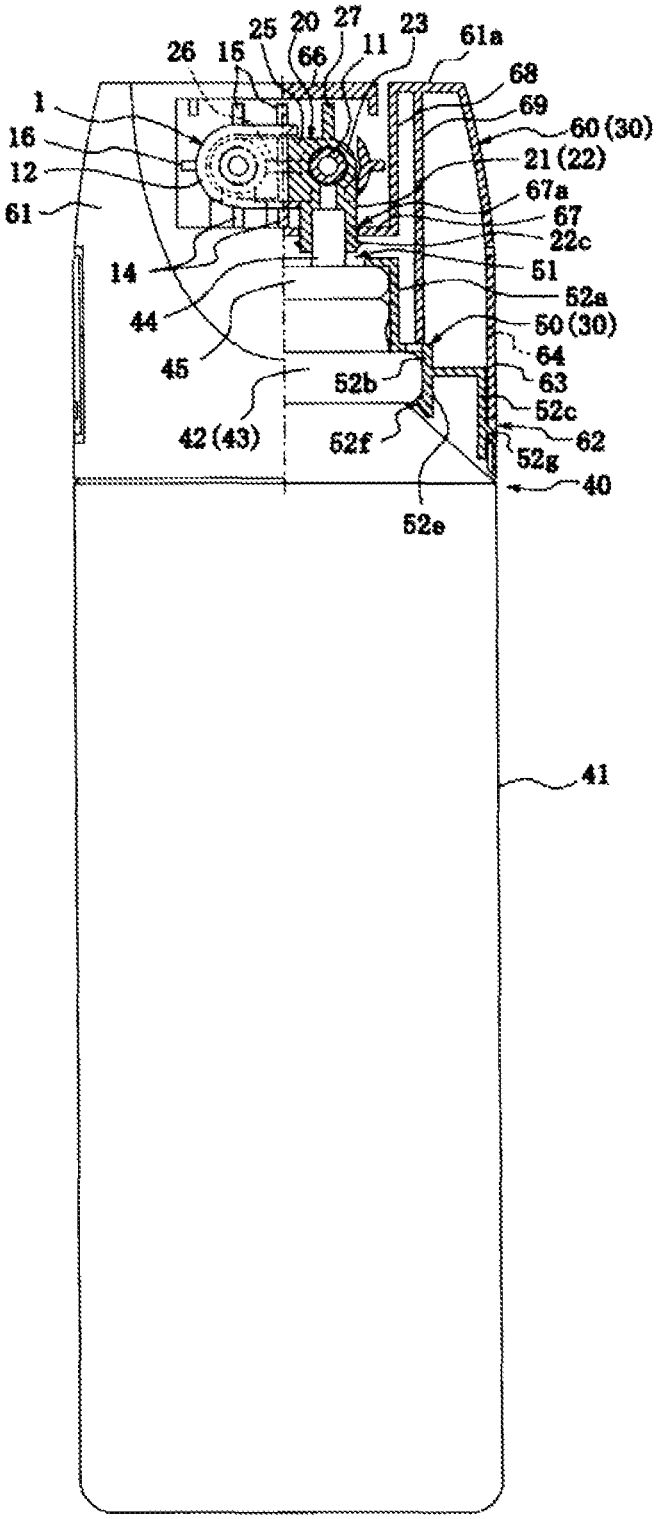
FIG. 2 is a half cross-sectional view along A-A of FIG. 1.
Figure 3:
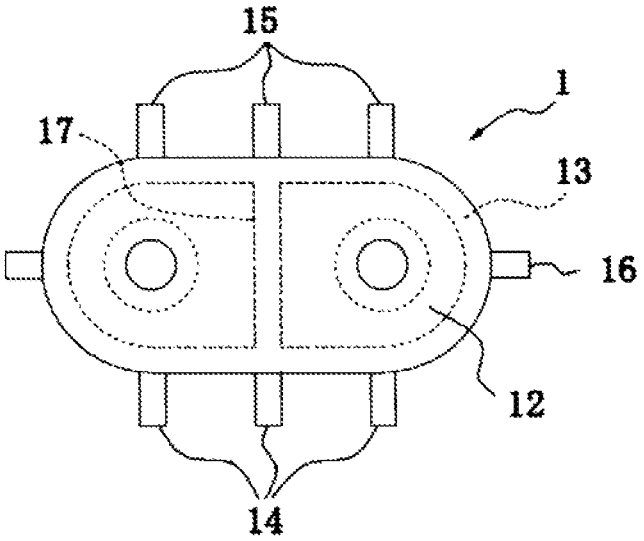
FIG. 3 is a front view of the nozzle cap for aerosol container of FIG. 1.

As shown in FIG. 1 and FIG. 2, the nozzle cap 1 is provided as a component separate from the aerosol container 40, which includes a nozzle 20 and a cover member 30, and can be used for cleaning the nozzle 20, and for preventing the nozzle from being pushed down.

The aerosol container 40 is formed by fixedly attaching a mounting cup 42 made of metal, for example, to a bottomed cylindrical container body 41 made of metal, for example, by crimping the outer edge of the cup (the crimped portion forming an annular rim 43), as shown in FIG. 2, and contains two types of contents separately inside. The aerosol container 40 includes a total of two stems 44 that lead to housing spaces of respective contents. A projection 45 that is shaped in the form of a track in plan view binds the two stems 44 and protrudes in the center of the mounting cup 42. The projection 45 may be rectangular or elliptical in plan view.

In this example, the cover member 30 is formed by a lower cover member (fixing plate) 50 fixed to the mounting cup 42 of the aerosol container 40, and an upper cover member 60 attached to the lower cover member 50. The cover member 30 need not necessarily be divided into the lower cover member 50 and upper cover member 60. The cover member 30 may be designed to be attached to the mounting cup 42.

The lower cover member 50 includes an outer wall 52, which covers the mounting cup 42 except an opening 51 for exposing the two stems 44, abuts on an upper face of the annular rim 43, and removably engages with a lower edge of the circumferential surface of the annular rim 43. The outer wall 52 includes a cylindrical upper tier part 52*a* with a top that is generally circular in plan view, a middle tier part 52*b* that extends radially outward from the lower end of the upper tier part 52*a* and downward from the outer edge, and a lower tier part 52*c* that extends radially outward from the lower end of the middle tier part 52*b* and downward from the outer edge.

Figure 8:
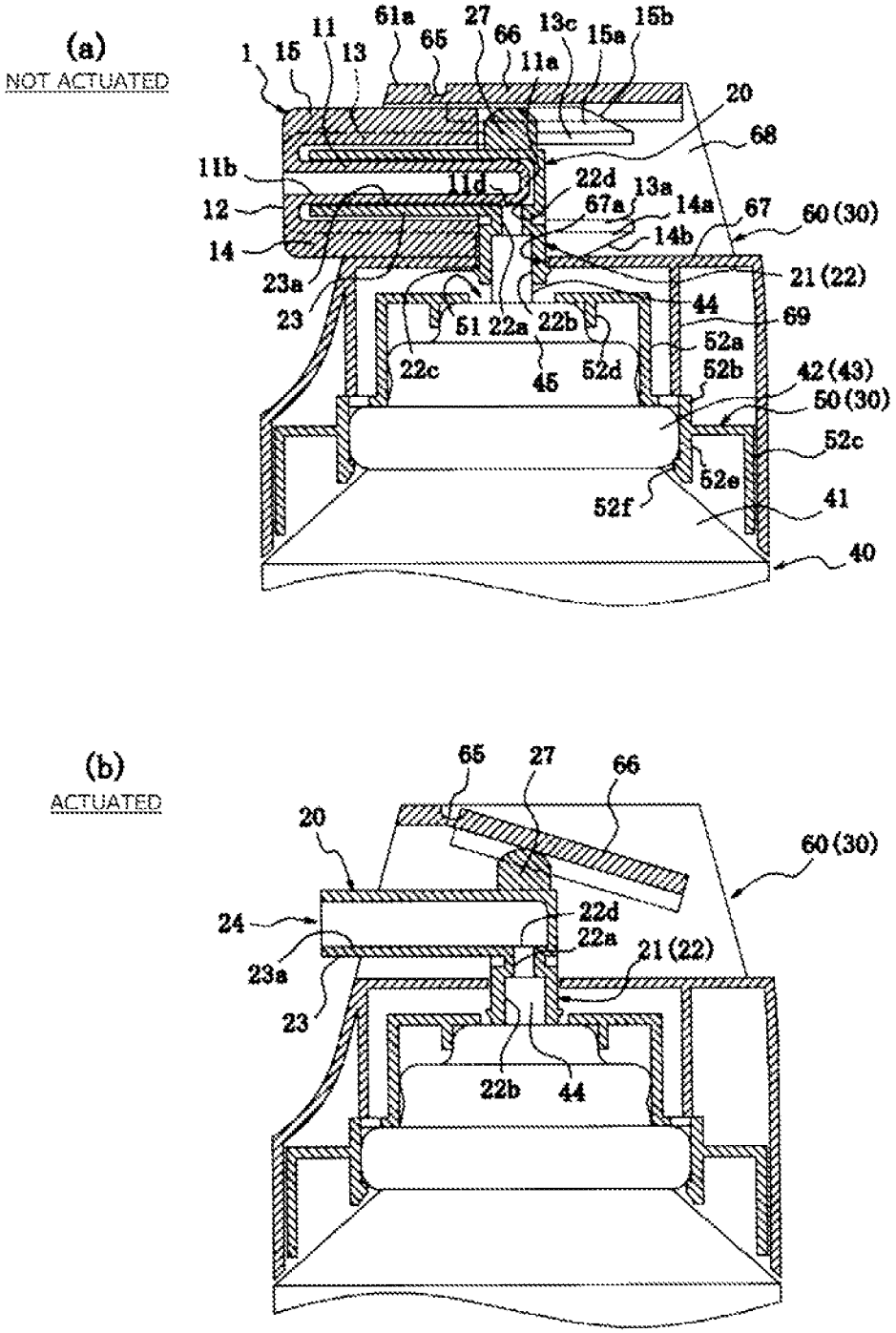
FIG. 8 is a cross-sectional view illustrating how the nozzle cap for aerosol container of FIG. 1 prevents the nozzle from being pushed down, (a) showing a state when the nozzle is not actuated, and (b) showing a state when the nozzle is actuated.

In a central part of the upper tier part 52*a* are provided positioning walls 52*d* extending downward to abut on both side faces along the longitudinal direction of the projection 45, as shown in FIG. 8. The opening 51 is shaped in the form of a track in plan view. The middle tier part 52*b* includes a downwardly extending cylindrical wall 52*e* as shown in FIG. 2. An engaging claw 52*f* is circumferentially provided to an inner circumferential surface of the cylindrical wall 52*e* to engage with a lower edge of the circumferential surface of the annular rim 43, thereby anchoring the lower cover member 50 to the mounting cup 42.

The circumferential wall of the lower tier part 52*c* is positioned radially inner than the outer circumferential surface of the aerosol container 40. Outward claws 52*g* are provided at two points on both sides of the axial line of the lower cover member 50.

The upper cover member 60 includes a circumferential wall 61 having an outer shape with substantially the same diameter as the outer circumferential surface of the aerosol container 40 and accommodates the lower tier part 52*c* of the lower cover member 50 inside. On the side face of the circumferential wall 61 are pivoting pieces 63 each formed with an engaging hole 62 that is to engage with the claw 52*g*. The pivoting pieces 63 are connected to the circumferential wall 61 in the front and the back by connecting pieces 64. Pressing upper regions of the pivoting pieces 63 above the connecting pieces 64 inward turns the pivoting pieces 63 around the connecting pieces 64, whereby the engaging holes 62 move outward and are disengaged from the claws 52*g*.

The upper part of the circumferential wall 61 is frustum-shaped, with a top wall 61*a* having a cut-out portion in the back, and with an actuator part 66 being provided in this cut-out portion such as to be rotatable via a hinge 65, as shown in FIG. 1, FIG. 2, and FIG. 8. Inside the circumferential wall 61 is formed an inner bottom wall 67 that covers the upper tier part 52*a* of the lower cover member 50 continuously with the top wall 61*a* via inner side walls 68. An inner circumferential wall 69 extends downward from the top wall 61*a* and inner bottom wall 67 on the radially outer side of the inner side walls 68, and abuts on the upper face of the middle tier part 52*b* of the lower cover member 50. Two openings 67*a* are provided in a central part of the inner bottom wall 67 for the stems 44 each to pass through.

The nozzle 20 includes a stem connector 21 at one end to be connected to the stems. The stem connector 21 is formed by two stem-side tubes 22, each of which forms an independent stem-side communication passage 22*a* extending upwards from each stem 44. The lower part of each stem-side tube 22 has an increased diameter, and the stem 44 is inserted into this large-diameter part 22*b*. An engaging convex section 22*c* is circumferentially formed near the lower end on the outer circumferential surface of each stem-side tube 22, and with these engaging convex sections 22*c* engaging with the openings 67*a* formed in the inner bottom wall 67 of the upper cover member 60, the nozzle 20 is retained to the upper cover member 60.

The nozzle 20 includes two ejection tubes 23 at the other end. Each ejection tube 23 forms an independent ejection-side communication passage 23*a* extending forward from an upper end 22*d* of the stem-side communication passage 22*a*, and has an ejection port 24 at the front end of the ejection-side communication passage 23*a*. At the rear ends of the two ejection tubes 23 are provided a vertical rib 25 and a horizontal rib 26 that connect these rear ends.

Ribs 27 with an arcuate tip are provided to protrude from the upper face at rear ends of respective ejection tubes 23, so that, when the actuator part 66 is pressed, the lower face of the actuator part 66 abuts on the upper face of the ribs 27, whereby the contents are expelled simultaneously from the respective stems 44.

The nozzle cap 1 is configured as shown in FIG. 3 to FIG. 7, and attached to the previously described nozzle 20 of the aerosol container 40 as shown in FIG. 1, FIG. 2, and FIG. 8(*a*). The nozzle cap 1 includes two hollow bar-like pieces 11 with a closed distal end 11*a* and an open base end 11*b*, and a circumferential wall 13 that is formed continuously to the base ends 11*b* of the two bar-like pieces 11 via a front wall 12 and surrounds the two bar-like pieces 11. The nozzle cap 1 is symmetrical in the up and down direction and in the left and right direction.

Figure 4:
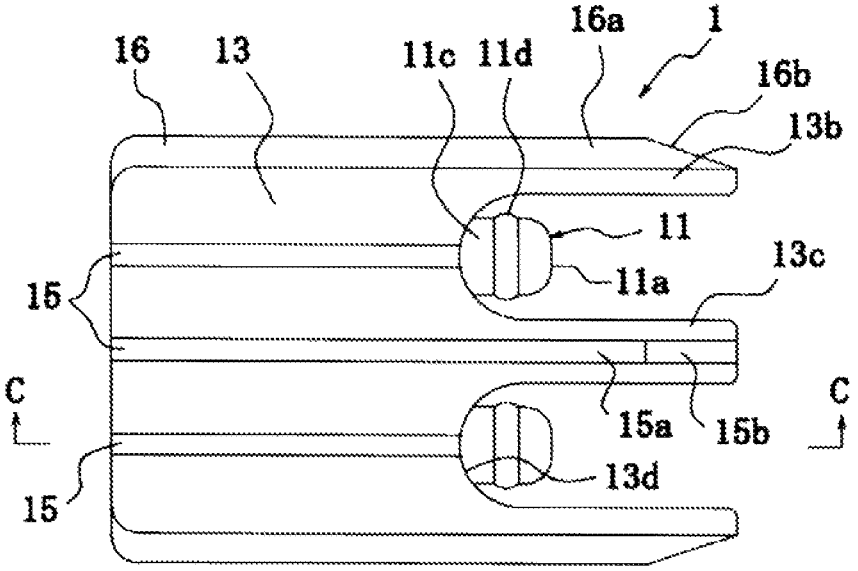
FIG. 4 is a plan view of the nozzle cap for aerosol container of FIG. 1.
Figure 5:
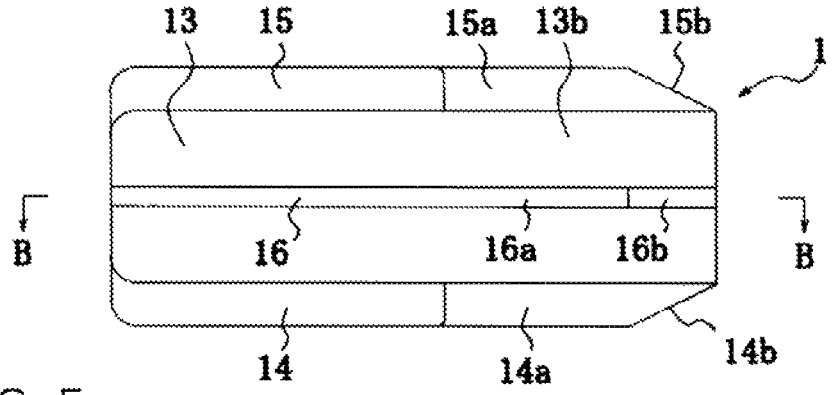
FIG. 5 is a side view of the nozzle cap for aerosol container of FIG. 1.
Figure 6:
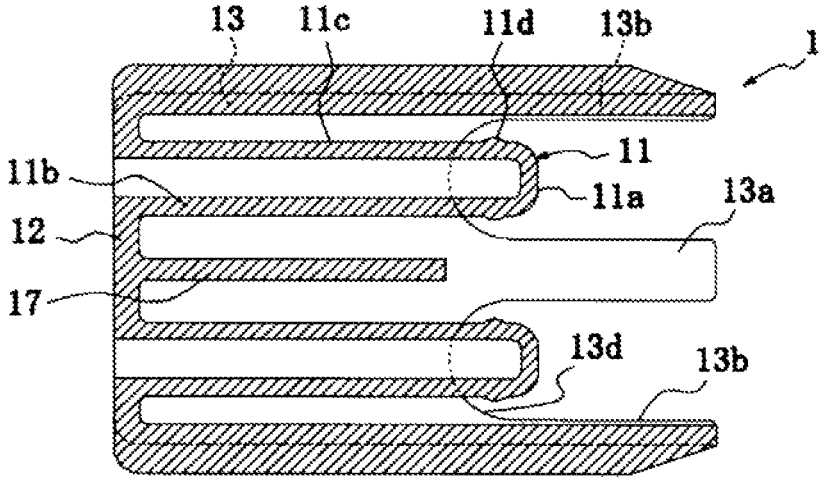
FIG. 6 is a cross-sectional view along B-B of FIG. 5.
Figure 7:
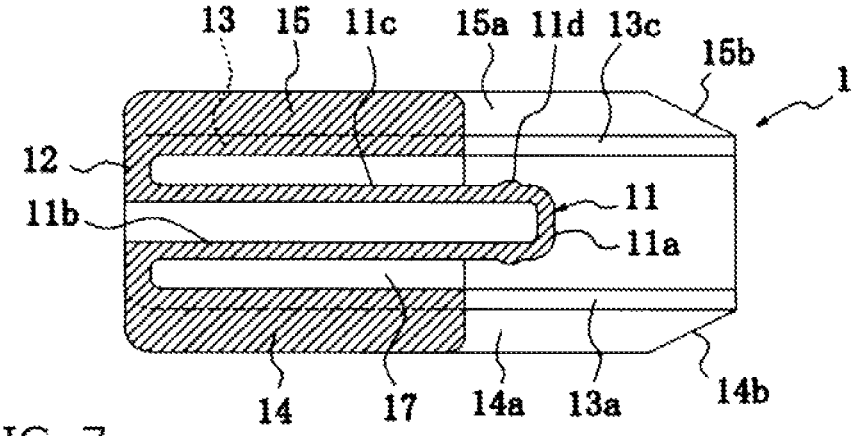
FIG. 7 is a cross-sectional view along C-C of FIG. 4.

The bar-like pieces 11 are each formed to have a length that is the same or somewhat longer than the front-to-back length of the ejection-side communication passages 23*a* of the nozzle 20, and can be inserted into the ejection-side communication passages 23*a* until the distal ends 11*a* reach the upper ends 22*d* of the stem-side communication passages 22*a*. The outer circumferential surface 11*c* of each bar-like piece 11 has substantially the same diameter as that of the ejection-side communication passages 23*a*. An annular protrusion 11*d* is circumferentially formed near the distal end 11*a* of each bar-like piece 11. The annular protrusion 11*d* has an outer diameter that is the same or somewhat larger than the diameter of the ejection-side communication passage 23*a* so that it can slide on the surface of the ejection-side communication passage 23*a*. The annular protrusion 11*d* may be provided closer to the distal end or base end than the position shown in FIG. 4. The position shown in FIG. 4 is preferable because, at this position, the annular protrusions 11*d* can engage with the upper ends 22*d* of the stem-side communication passages 22*a* when the bar-like pieces 11 are inserted into the ejection-side communication passages 23*a*. The cross-sectional shape along the front to back direction of the annular protrusions 11*d* is not limited to the arcuate shape shown in FIG. 6, but may be, for example, triangular and rectangular or the like.

The circumferential wall 13 is formed such as to surround the ejection tubes 23 of the nozzle 20 when the bar-like pieces 11 are inserted into the ejection-side communication passages 23*a*. The circumferential wall 13 includes a lower extension 13*a* in a lower part, which extends to the back through between the two stem-side tubes 22 when the bar-like pieces 11 are inserted into the ejection-side communication passages 23*a*. Lateral extensions 13*b* that extend to the back similarly to this lower extension 13*a* are formed in portions on both sides of the circumferential wall 13. An upper extension 13*c* that extends to the back similarly to the lower extension 13*a* is formed in an upper part of the circumferential wall 13. Rear edge portions 13*d* of the circumferential wall 13 are semicircular between the lower extension 13*a* and the lateral extensions 13*b*. Rear edge portions 13*d* of the circumferential wall 13 are semicircular also between the upper extension 13*c* and the lateral extensions 13*b*.

Three lower ribs 14 (lower protrusions), which abut on the inner bottom wall 67 of the cover member 30 below the ejection tubes 23 of the nozzle 20 when the bar-like pieces 11 are inserted into the ejection-side communication passages 23*a* to thereby prevent the nozzle 20 from being pushed down, are provided to protrude from the lower face of the outer circumference of the circumferential wall 13. The lower ribs 14 each extend along the front to back direction. The lower rib 14 in the middle includes a lower extension 14*a* that extends to the back through between the two stem-side tubes 22 when the bar-like pieces 11 are inserted into the ejection-side communication passages 23*a*. The rear edge 14*b* of the lower extension 14*a* is tapered, or sloped downward toward the front.

Three upper ribs 15 (upper protrusions), which abut on the actuator part 66 by the actuator part 66 being pressed down when the bar-like pieces 11 are inserted into the ejection-side communication passages 23*a*, are provided to protrude from the upper face of the outer circumference of the circumferential wall 13. The upper ribs 15 extend along the front to back direction as with the lower ribs 14. The upper rib 15 in the middle includes an upper extension 15*a* that extends to the back through between the two ribs 27 provided on the upper face at the rear ends of the ejection tubes 23 of the nozzle 20 when the bar-like pieces 11 are inserted into the ejection-side communication passages 23*a*. The rear edge 15*b* of the upper extension 15*a* is tapered, or sloped upward toward the front.

Lateral ribs 16, which face the inner side walls 68 of the upper cover member 60 with a slight gap therebetween when the bar-like pieces 11 are inserted into the ejection-side communication passages 23*a*, are provided to protrude from both side faces of the outer circumference of the circumferential wall 13. The lateral ribs 16 include a lateral extension 16*a* protruding from the lateral extensions 13*b* of the circumferential wall 13. The rear edge 16*b* of each lateral rib 16 is tapered, or sloped away from the circumferential wall 13 toward the front.

On the inner circumferential side of the circumferential wall 13 is provided a reinforcing rib 17 that connects the upper face and lower face of the inner circumference of the circumferential wall 13 at the center in the left-right direction of the nozzle cap 1 (i.e., connects the upper rib 15 in the middle and the lower rib 14 in the middle straight in the up and down direction).

With this configuration, when the nozzle cap 1 is attached to the nozzle 20 of the aerosol container 40 that is not in use, the tapered rear edges 14*b*, 16*b*, and 15*b* of the lower rib 14 in the middle, the lateral ribs 16, and the upper rib 15 in the middle that protrude from the circumferential wall 13 of the nozzle cap 1 function as guides when they come to contact with the front edges of the inner bottom wall 67, inner side walls 68, and top wall 61*a* of the upper cover member 60, thereby facilitating the attachment of the nozzle cap 1 to the nozzle 20.

Once the nozzle cap 1 is attached to the nozzle 20, with the bar-like pieces 11 of the nozzle cap 1 being inserted into the ejection-side communication passages 23*a* as shown in FIG. 8(*a*), the annular protrusions 11*d* circumferentially formed near the distal ends 11*a* of the respective bar-like pieces 11 engage with the upper ends 22*d* of the stem-side communication passages 22*a*, so that the nozzle cap 1 can be reliably kept attached.

Even if the actuator part 66 is pressed down in this state, the lower ribs 14 protruding from the circumferential wall 13 of the nozzle cap 1 abut on the inner bottom wall 67 of the cover member 30 below the ejection tubes 23 of the nozzle 20, so that the nozzle 20 can be prevented from being pushed down. At this time, the upper ribs 15 protruding from the upper face on the outer circumference of the circumferential wall 13 abut on and support the actuator part 66, so that breakage of the two ribs 27 on the upper face at the rear ends of the ejection tubes 23 of the nozzle 20 by the pressing of the actuator part 66 can be reliably prevented.

Since the circumferential wall 13 is provided with the lower extension 13*a* and upper extension 13*c* that extend to the back in the lower and upper parts, respectively, and since the lower rib 14 in the middle and the upper rib 15 in the middle are provided with the lower extension 14*a* and upper extension 15*a*, respectively, which extend to the back, the actuator part 66 can be supported in a wider area when pressed down, so that the nozzle 20 can reliably be prevented from being pushed down.

When the aerosol container 40 is in use, the nozzle cap 1 is removed from the nozzle 20 and the actuator part 66 is pressed down as shown in FIG. 8(*b*), which causes the lower face of the actuator part 66 to abut on the upper face of the ribs 27, whereby the nozzle 20 is pressed down, and the contents are expelled simultaneously from the respective stems 44 and ejected from the ejection ports 24.

Figure 9:
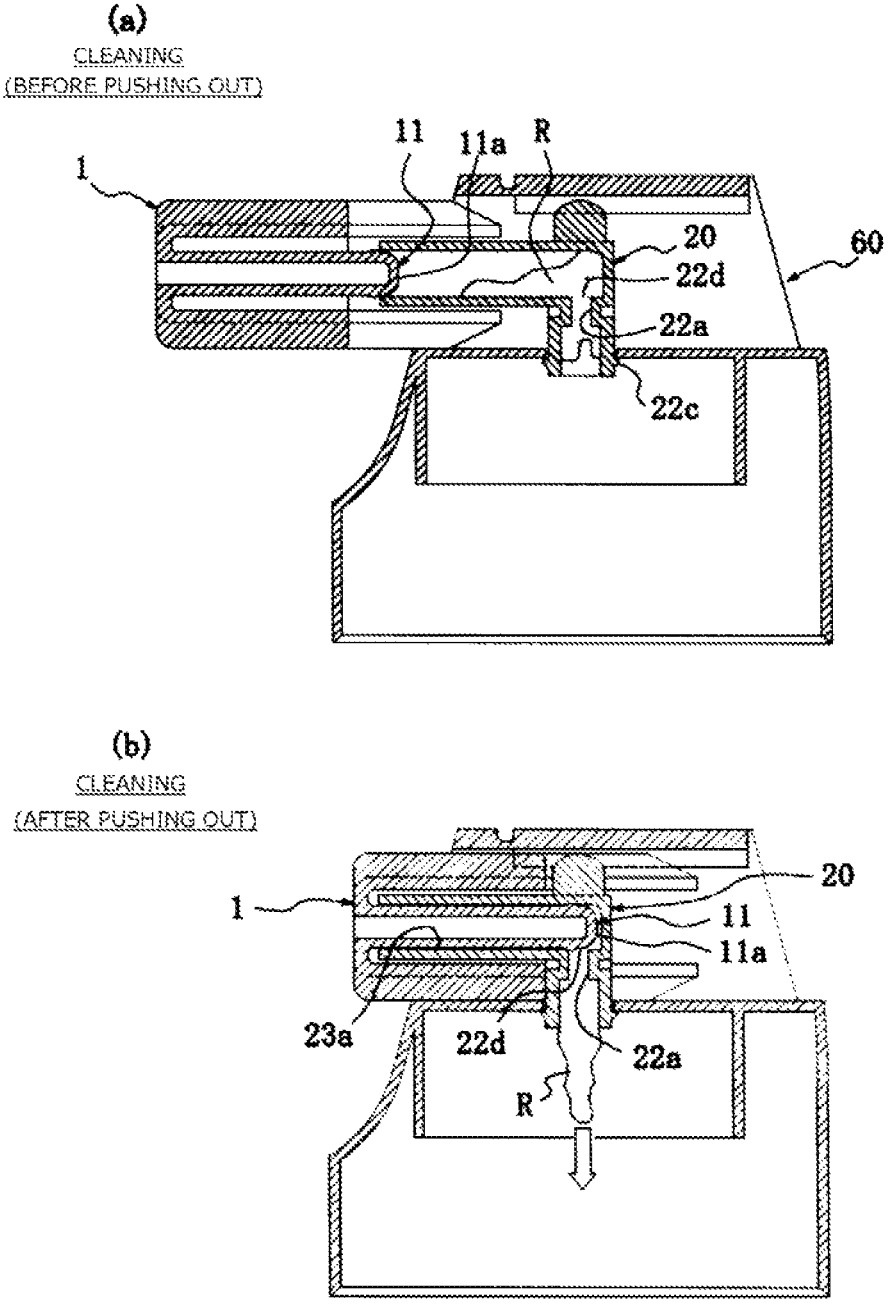
FIG. 9 is a cross-sectional view illustrating how the nozzle is cleaned with the nozzle cap for aerosol container of FIG. 1, (a) showing a state before a residual material is pushed out, and (b) showing a state after the residual material is pushed out.

To clean the nozzle 20, the pivoting pieces 63 of the upper cover member 60 shown in FIG. 2 are operated to remove the upper cover member 60 from the lower cover member 50, whereby the nozzle can be removed together with the upper cover member 60, as shown in FIG. 9(*a*). At this time, the engaging convex sections 22*c* that retain the nozzle 20 to the upper cover member 60 prevents the nozzle 20 from coming off.

As shown in FIG. 9(*b*), by inserting the two bar-like pieces 11 of the nozzle cap 1 each into the ejection-side communication passages 23*a* until the distal ends 11*a* of the bar-like pieces 11 reach the upper ends 22*d* of the stem-side communication passages 22*a* of the nozzle 20, the contents R remaining inside the ejection-side communication passages 23*a* can be pushed out of the nozzle 20 through the stem-side communication passages 22*a*. At this time, the annular protrusions 11*d* each circumferentially formed near the distal ends 11*a* of the bar-like pieces 11 slide on the surface of the ejection-side communication passages 23*a* as the bar-like pieces 11 are inserted into the ejection-side communication passages 23*a*, whereby the contents R remaining inside the ejection-side communication passages 23*a* can be emptied more reliably. The ejection-side communication passages 23*a* and stem-side communication passages 22*a* of the nozzle 20 can then be rinsed with running water, for example, with ease, and thus the cleaning of the nozzle 20 is facilitated.

The two types of contents R contained in the aerosol container 40 described in the embodiment may be a primary agent and additives of an aerosol product in the form of a foam, for example, which should preferably be not premixed together as they undergo a chemical reaction such as hardening and oxidation. The nozzle cap 1 according to this embodiment is suited for applications where the content R is an aerosol product such as hot shaving cream, hair dye, adhesive, paint, and medicine, and is particularly suitable for applications where the content R is a creamy liquid that can easily clog when dried.

While one embodiment of the present invention has been described for illustrative purposes only, various changes can be made within the scope of the claims. For example, the lower protrusion was described as being composed of three lower ribs 14, but the number of the ribs need not necessarily be three and can be adjusted to any number. The lower protrusion need not necessarily be ribs, and other shapes can be adopted. As with the lower protrusion, the number of the ribs that form the upper protrusion is not limited to three and other shapes than ribs can be adopted.

The invention claimed is:

1. A nozzle cap for aerosol container to be attached to an aerosol container that includes a nozzle connected to a plurality of stems of a mounting cup at one end and having an ejection port at the other end, and a cover member attached to the mounting cup, the nozzle including a stem connector that forms stem-side communication passages independently extending upward from respective stems, and ejection tubes that form ejection-side communication passages independently extending forward from upper ends of the respective stem-side communication passages, the nozzle cap comprising:

a plurality of bar-like pieces that can be inserted from the ejection port of the nozzle into the respective ejection-side communication passages at least until distal ends of the bar-like pieces reach the upper ends of the respective stem-side communication passages;

a circumferential wall formed continuously to base ends of the plurality of bar-like pieces via a front wall to surround the ejection tubes when the bar-like pieces are inserted into the ejection-side communication passages; and a lower protrusion protruding from an outer circumferential surface of the circumferential wall and abutting on the cover member below the ejection tubes of the nozzle when the bar-like pieces are inserted into the ejection-side communication passages, to thereby prevent the nozzle from being pushed down, wherein the stem connector of the nozzle is formed by a plurality of stem-side tubes that form independent stem-side communication passages, and wherein the circumferential wall and the lower protrusion each include an extension that extends backward through between the plurality of stem-side tubes when the bar-like pieces are inserted into the ejection-side communication passages.

2. The nozzle cap for aerosol container according to claim 1, wherein the cover member includes an actuator part that is provided above the nozzle and presses down the nozzle when turned via a hinge, and the nozzle cap further comprises an upper protrusion protruding from the outer circumferential surf ace of the circumferential wall and abutting on the actuator part by the actuator part being pressed down when the bar-like pieces are inserted into the ejection-side communication passages.

3. The nozzle cap for aerosol container according to claim 1, wherein the two bar-like pieces each include an annular protrusion that makes sliding contact with the surface of the stem-side communication passages.

4. The nozzle cap for aerosol container according to claim 2, wherein the two bar-like pieces each include an annular protrusion that makes sliding contact with the surface of the stem-side communication passages.

5. The nozzle cap for aerosol container according to claim 3, wherein the annular protrusions each can engage with the upper ends of the stem-side communication passages when the bar-like pieces are inserted into the ejection-side communication passages.

6. The nozzle cap for aerosol container according to claim 4, wherein the annular protrusions each can engage with the upper ends of the stem-side communication passages when the bar-like pieces are inserted into the ejection-side communication passages.

* * * * *